United States Patent [19]

DeLigt et al.

[11] Patent Number: 5,039,375

[45] Date of Patent: Aug. 13, 1991

[54] VENEER EDGE GLUE APPLICATOR

[75] Inventors: John DeLigt, Covington, Va.; Lee E. Veneziale, Tyrone, Pa.

[73] Assignee: Westvaco Corporation, New York, N.Y.

[21] Appl. No.: 534,477

[22] Filed: Jun. 7, 1990

[51] Int. Cl.[5] ..... B65L 11/04

[52] U.S. Cl. ..... 156/578; 156/546; 118/242

[58] Field of Search ..... 156/356, 524, 546, 548, 156/574, 544, 559, 563, 578; 118/252, 258, 241; 101/123; 412/8, 37

[56] References Cited

U.S. PATENT DOCUMENTS

| | | | |
|---|---|---|---|
| Re. 21,593 | 10/1940 | Friz | 156/546 |
| 1,643,194 | 9/1927 | Black | 156/546 |
| 1,739,088 | 12/1929 | Perry | 156/546 |
| 1,771,105 | 7/1930 | Williams | 156/546 |
| 1,903,373 | 4/1933 | Dennis | 156/546 |
| 2,317,446 | 4/1943 | Dennis | 156/546 |
| 2,351,946 | 6/1944 | Friz | 156/546 |
| 2,398,353 | 4/1946 | Bolling | 156/546 |
| 3,956,057 | 5/1976 | Jung | 118/242 |
| 4,551,124 | 11/1985 | Mowry | 156/546 |

*Primary Examiner*—David A. Simmons
*Assistant Examiner*—Robert Barker
*Attorney, Agent, or Firm*—W. A. Marcontell; R. L. Schmalz

[57] ABSTRACT

Bundles of presized wood veneer strips are prepared for longitudinal edge adhesive by vertical alignment of the veneer strip face planes on a horizontal machine bed surface between open clamp jaws. Upon satisfactory alignment of the strip edges on the bed surface, the clamp jaws are closed on the bundle and translated from the bed surface to a horizontal adhesive transfer plane. An adhesive transfer carriage traverses the bundle length to coat the veneer strip bottom edges by a rotatively driven wheel having a lower chordal segment immersed within an adhesive reservoir. After completing the adhesive application pass, the clamp jaws are opened on manual command to release the veneer strip bundle to manual inversion. While the clamp jaws are open, the adhesive transfer carriage is returned to the starting position with a non-rotating adhesive application wheel. Neither the adhesive application wheel nor the adhesive reservoir are structurally secured to the transfer carriage frame to facilitate respective isolation and solvent immersion for cleaning.

6 Claims, 6 Drawing Sheets

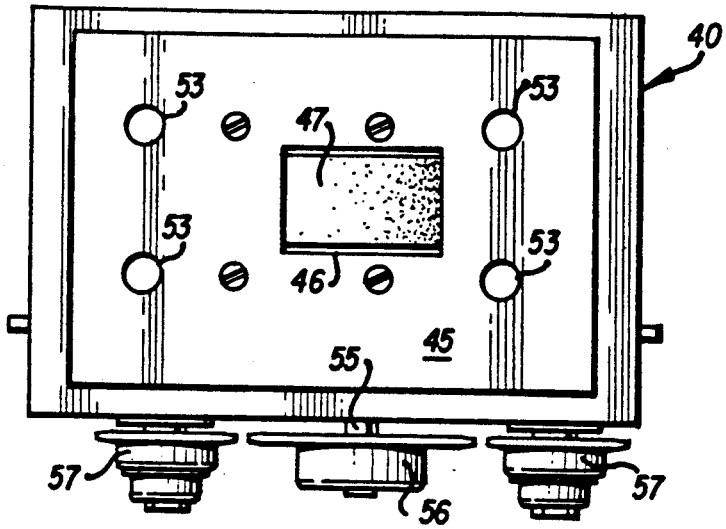
FIG. 7
FIG. 8
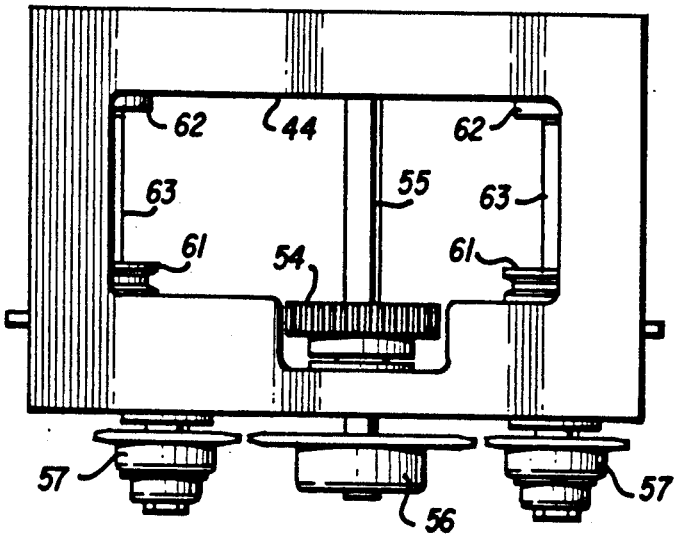
FIG. 10
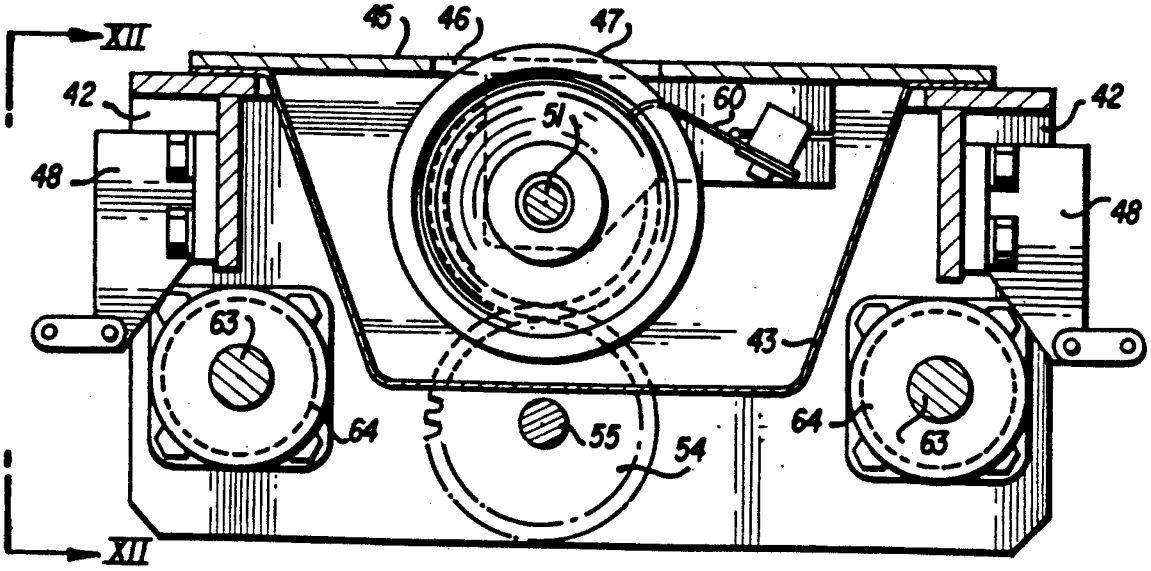

VENEER EDGE GLUE APPLICATOR

BACKGROUND OF THE INVENTION

1. Field of the Invention

The present invention relates to the art of wood veneering. More particularly, apparatus is disclosed for fabricating wide, integral panels from numerous narrow veneer strips.

2. Description of the Prior Art

Veneering is a craft of cladding the surface of a substrate with thin sheets of natural wood; usually of less than 1/16 inch thickness. Such veneer sheets are secured to the substrate surface adhesively.

The usual objective of veneering is to provide the veneered article with the visual texture and feel of one fabricated from a solid or integral piece of the veneer wood without the economic burden frequently associated with many aesthetically desirable wood species. Alternatively, the objective may be to give metallic structure a wood construction appearance.

In many cases, aesthetically desirable wood species have natural growth characteristics that preclude the production of wide, clear-grain boards from the species. Accordingly, a large article, such as a table top, produced from an aesthetic species, even of solid wood construction, must be fabricated by a laminated assembly of relatively small, solid wood strips. Practiced artistically, the craft of veneering includes discrete grain matching among these constituent strips to create intricate surface patterns.

Traditionally, the veneer artist has matched the grain of thin wood sheets or strips, one at a time, directly onto the substrate surface, to simulate the visual result of a solid laminate: a slow and painstaking process. Prior art efforts to commercially simulate this visual result have produced machines which mechanically adhere veneer strips or sheets together along longitudinal edges to create wide, composite sheets that are quickly and efficiently laid upon the entirety of a large, flat area substrate surface and secured by contact or hot melt adhesive.

Production of such wide sheets by one commercial process includes the bundled assembly of presized, 6 to 8 foot lengths of veneer strips. Under clamp pressure, with a horizontal sheet plane, a catalyzed urea resin adhesive is sprayed or rolled upon the vertical plane of the compacted sheet edges. After the adhesive has air dried, the bundle is disassembled. Finally, the individual veneer strips are reassembled in a single plane by heat curing edge-to-edge joints under simultaneous compressive stress.

Although the foregoing process functions reasonably well, given the fact that considerable individual artistry and discretion remains, the edge adhesive application step is less than satisfactory. Due to poor edge alignment in the vertical plane when clamped, adhesive is resultantly applied to small portions of the veneer face. If the adhesive is sprayed, the overspray is a source of atmospheric contamination and health hazard. If the adhesive is rolled on, the coating is frequently irregular and insufficient in large areas.

It is an object of the present invention, therefore, to provide the plane of veneer strip edges with a uniformly applied adhesive coating of adequate and regulated thickness.

Another object of the present invention is to provide an application roller assembly that may be quickly and conveniently disassembled for cleaning an servicing.

SUMMARY OF THE INVENTION

These and other objects of the invention, as will hereafter become apparent, are achieved by an apparatus that receives a bundle or batch quantity of presized veneer strips in parallel, vertical plane alignment between clamp jaws. All strips within a batch are fully supported along one longitudinal edge by a horizontal plane bed.

After edge alignment and clamping, the clamp structure translates the compacted bundle of veneer strips from the edge alignment bed position to a horizontal adhesive application plane along the course of a full traverse, horizontal axis, adhesive application carriage. As a tow line draws the carriage along the bundle length, a rotatively driven wheel carried by the carriage turns partially immersed within an adhesive supply pond. A doctor blade regulates adhesive film thickness clinging to the wheel surface, and, hence, the quantity of adhesive transferred to the veneer strip edges. Upon return of the adhesive application carriage to the starting position, the application wheel rotational drive is disengaged.

BRIEF DESCRIPTION OF THE DRAWINGS

With reference to the drawings wherein like reference characters designate like or similar elements throughout the several figures of the drawings:

FIG. 7 is a top plan of the adhesive application wheel carriage with the adhesive application wheel and glue pass cover in place;

FIG. 8 is a top plan of the adhesive application wheel carriage with the adhesive application wheel and glue pan cover removed;

FIG. 10 is a sectional side elevation view of the adhesive application wheel carriage assembly as viewed along cutting plane X—X of FIG. 11;

DESCRIPTION OF THE PREFERRED EMBODIMENT

Figure 1:
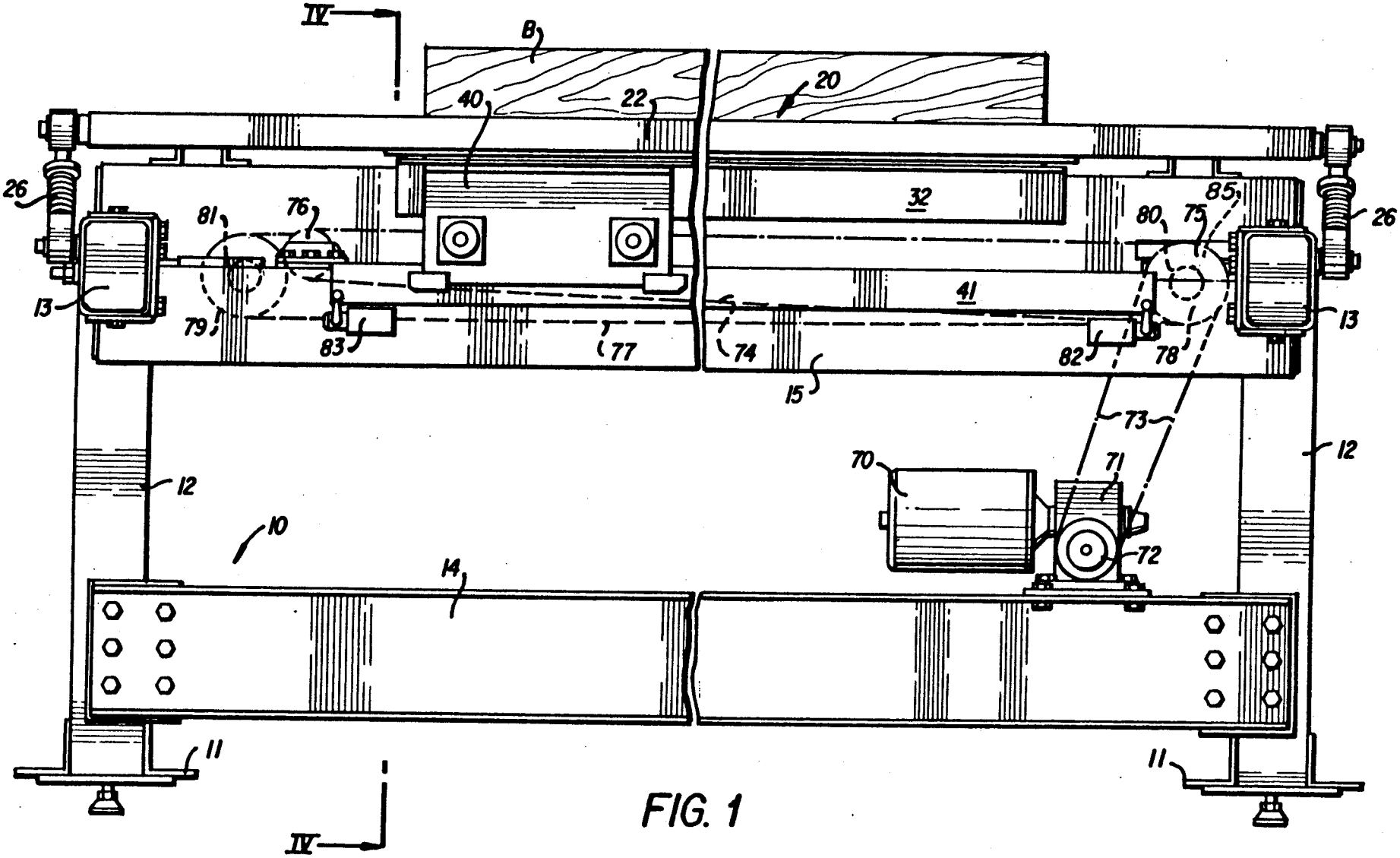
FIG. 1 is a frontal elevation of the presently disclosed apparatus.
Figure 2:
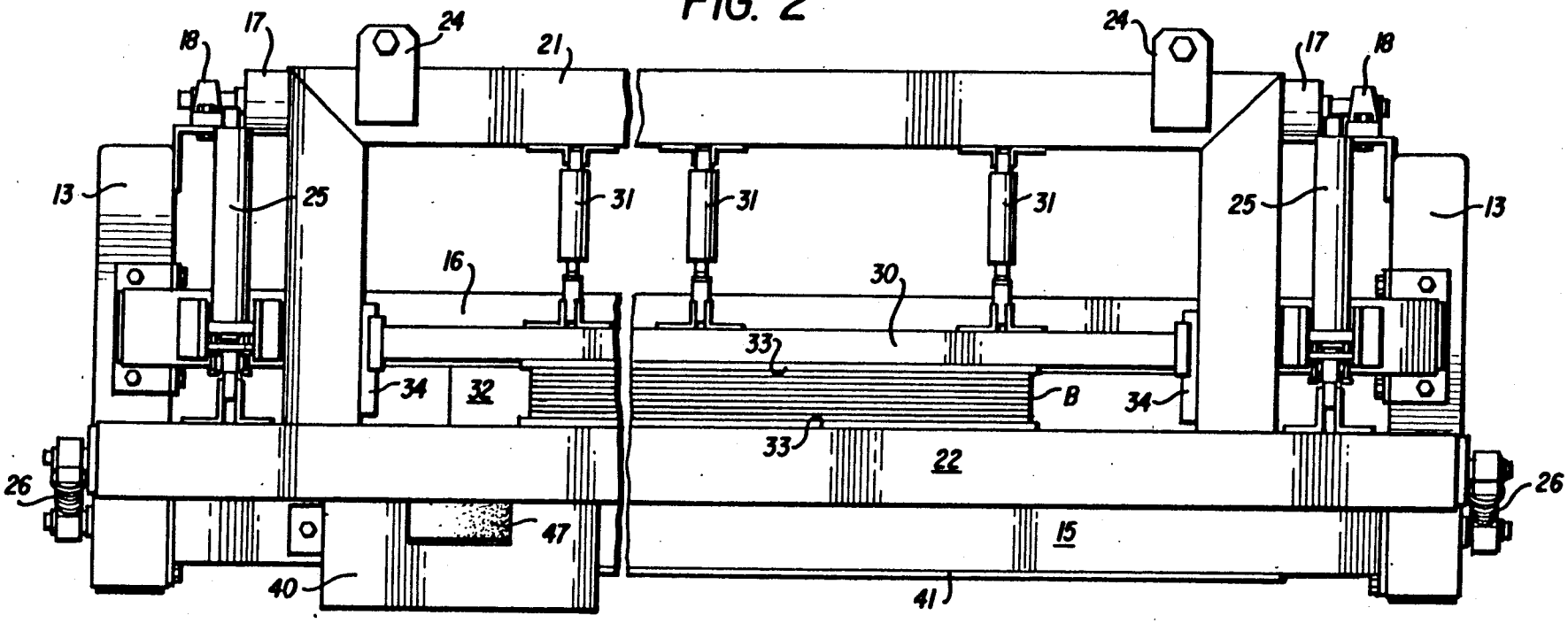
FIG. 2 is a top plan of the presently disclosed apparatus.

The three basic assemblies of the present invention are the static support frame 10, the clamp frame 20 and the adhesive carriage 40.

The static support frame 10 comprises two legs 12 tied together by a tie beam 14 and stabilized by respective foot structure 11. At the upper end of each leg 12, respective cantilever arms 13 are secured to project forward. Pillow blocks 18, secured to the upper end of each leg backside, support the axle ends of a machine length spanning torque tube 17.

Proximate of the arm 13 mid-length is a table beam 16 which supports a veneer strip alignment table 32 at a location compatible with the open jaws 33 of the clamp frame 20.

The clamp frame 20 comprises a welded assembly of a C-shaped yoke unit 21 to a base beam 22. By means of brackets 24 and torque arms 23, the clamp frame 20 is supported by the torque tube 17 for rotation about the torque tube axis. Both torque arms 23 are rigidly secured, as by welding, to the torque tube 17 at the same relative angle about the tube axis to keep the base beam 22 in parallel alignment with the strip alignment table 32.

The clamp frame 20 front end is supported by a pair of expansible pivot links 26 which are spring biased to the minimum length configuration. In combination with the clamp frame 20 and static frame 10, the pivotable torque arms 23 and expansible pivot links 26 operate as a four bar linkage that is positionally controlled by a pair of translation motors 25. A valve controlled fluid power source not shown such as air or oil drives a piston in and out of the motor 25 cylinder for the purpose of locating the clamp frame at either the loading position of FIG. 5 or the adhesive application position of FIG. 6.

Within the enclosure of yoke 21 is a sliding clamp bar 16 confined to parallel alignment with the clamp base beam 22 by guides 34. A plurality of piston/cylinder clamp motors 31 based against the yoke back bar 21 reciprocate the sliding clamp bar 16 between open and closed positions relative to the clamp jaw pads 33.

A pair of carriage tracks 41 are secured to the track beam 15 to support the adhesive transfer wheel carriage assembly 40. This carriage assembly is described with particular reference to FIGS. 7–12 and is constructed within a box frame 42 having a top plate. A cut-out 44 in the frame top plate permits a glue pan 43 to be carried as an unsecured drop-in within the frame 42 enclosure supported only by a perimeter flange thereby simplifying removal for cleaning and replenishment. The adhesive transfer wheel 47, having a resilient tire 49, is combined as a subassembly about an axle shaft 51 supported by pedestals 50. The pedestals are secured to wheel cover plate 45 which has a wheel cut-out 46 through which a small perimeter section of wheel 47 extends for veneer bundle "B" contact. Finger holes 53 expedite removal of the application wheel subassembly from the glue pan. It will be noted that the transfer wheel axle 51 extends through the mounting pedestal to receive a spur gear 52 on the end thereof by which the adhesive wheel 47 is rotatively driven. Such drive train completion includes a sprocket shaft 55 which supports a chain sprocket 56 on the outboard end and a transfer gear 54 inside the frame wall in planar alignment with the wheel drive gear 52.

Figure 13:
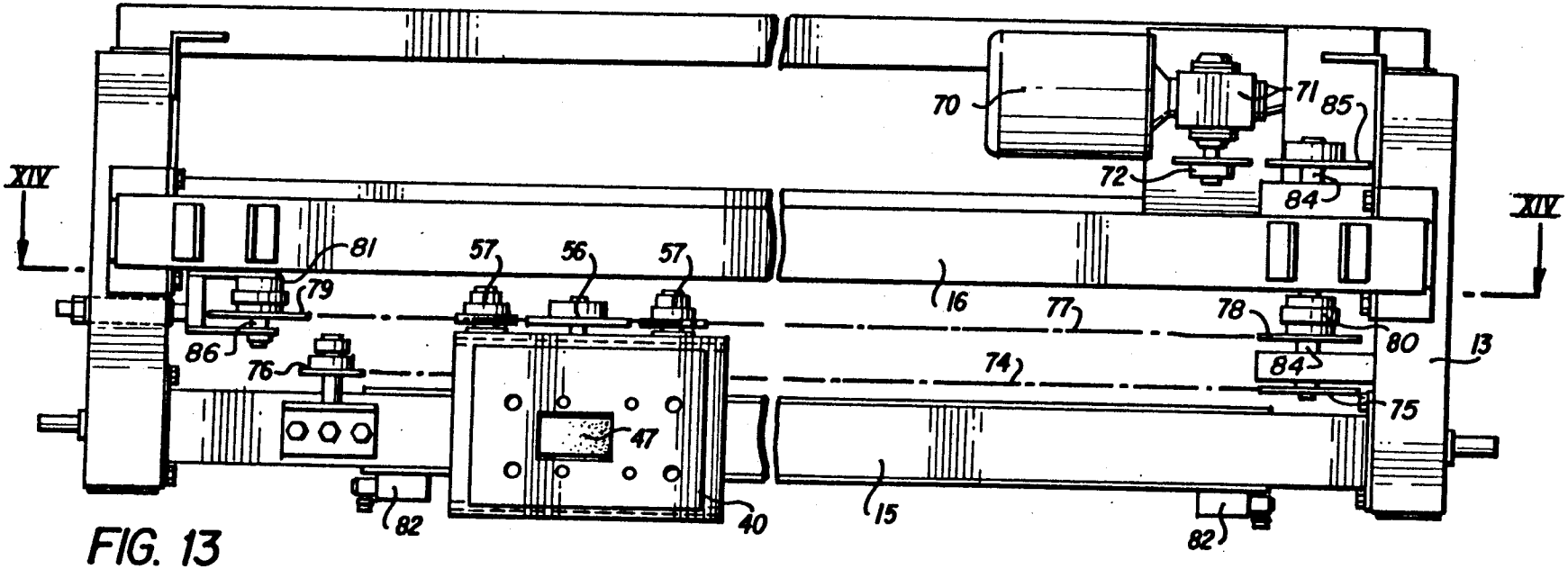
Figure 14:
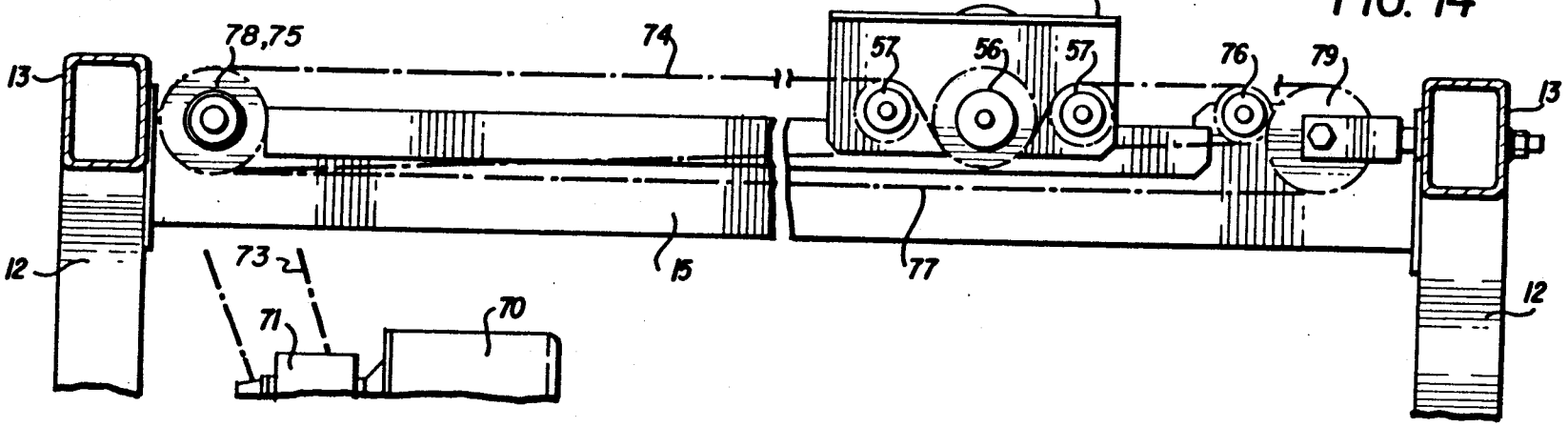

To confine a chain drive wrap about an arcuate portion of sprocket 56, two idler sprockets 57 are mounted on stub shafts 58 threaded into the side wall of frame 42. Adhesive application wheel drive chain 77 is threaded over the idler sprockets 57 and under the wheel drive sprocket 56. Relative to FIGS. 1, 13 and 14, the adhesive wheel drive chain 77 loop is completed about a head sprocket 78 and a tail sprocket 79. These sprockets are respectively secured to a jack shaft 84 and an idle shaft 86 by respective over-running clutches 80 and 81. Jack shaft 84 continues through the hub of over-running clutch 80 to receive carriage tow sprocket 75 over one end thereof and primary drive sprocket 85 over the other end. When the carriage 40 is driven from right to left, however, chain 77 follows the movement at the same speed thereby stopping rotation of the adhesive drive sprocket 56.

Carriage 40 traverse drive, right and left, is provided by traverse chain 74 which is secured at opposite chain ends to the carriage 40 at hitch brackets 48. In between, the chain 74 is threaded over an idler sprocket 76 and the jack shaft mounted tow sprocket 75. Jack shaft rotation is provided by a primary chain 73 driven by a reversible motor 70, speed reducer 71 and drive sprockets 72 and 85.

For direction and planar line control, the carriage 40 rides on four track wheels 61 and 62. Axles 63 carrying such track wheels are rotatively confined by bearings 64. The track wheel pair 61 on the drive side of the carriage assembly is flanged to confine the wheels laterally on the track 41 edge.

An operational cycle of the present invention begins with the clamp frame 20 in the retracted or rear-most position with the clamp jaws 33 open. In this position, the jaw opening is directly above the material alignment bed 32.

Figure 6:
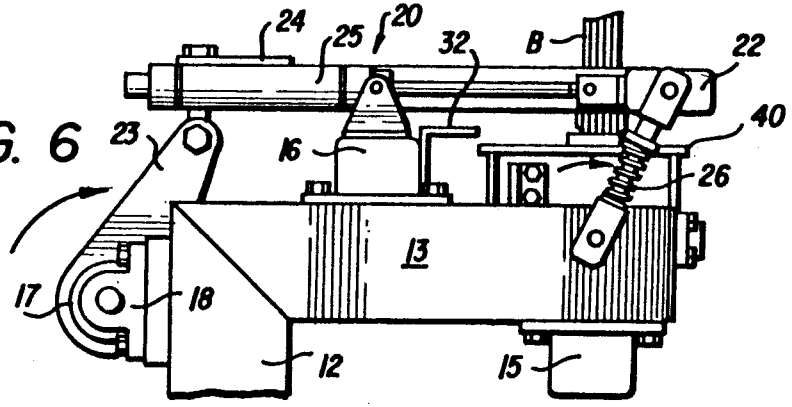
FIG. 6 is a left end elevational detail of the presently disclosed apparatus in the adhesive application position.
Figure 5:
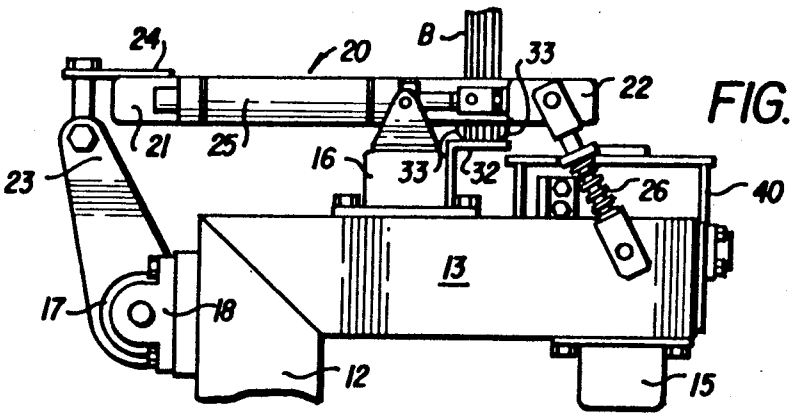
FIG. 5 is a left end elevational detail of the presently disclosed apparatus in the material loading position.
Figure 4:
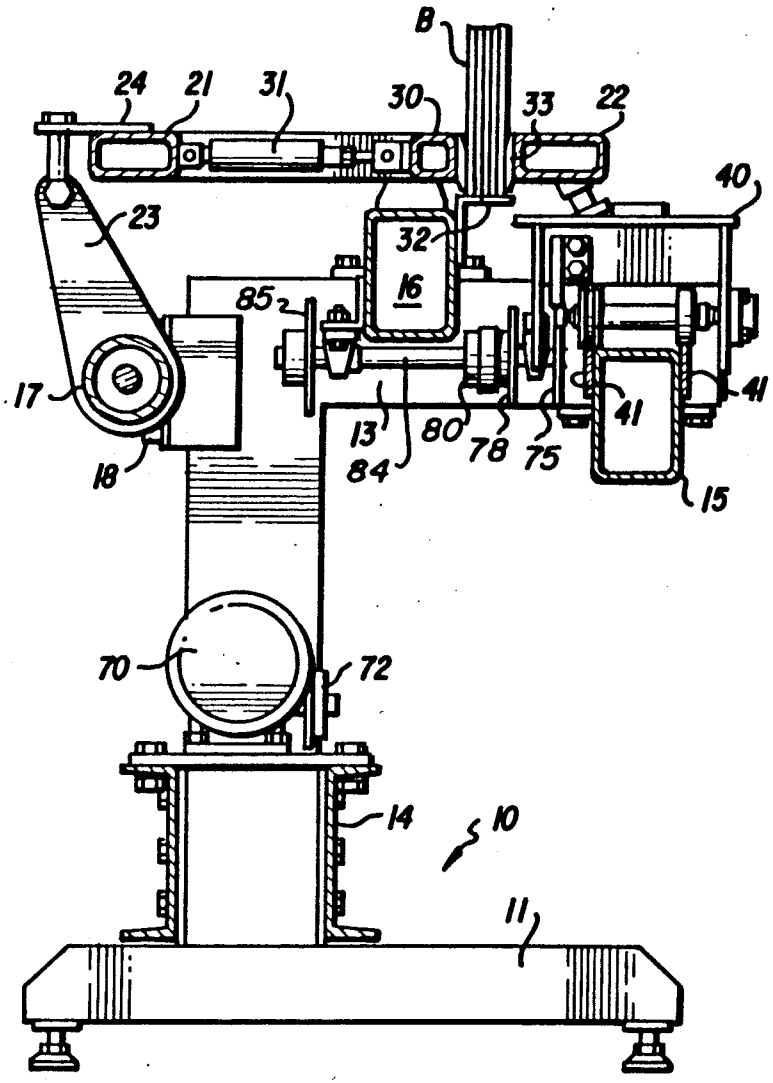
FIG. 4 is a sectional elevation of the presently disclosed apparatus as viewed along cutting plane IV—IV of FIG. 1.
Figure 3:
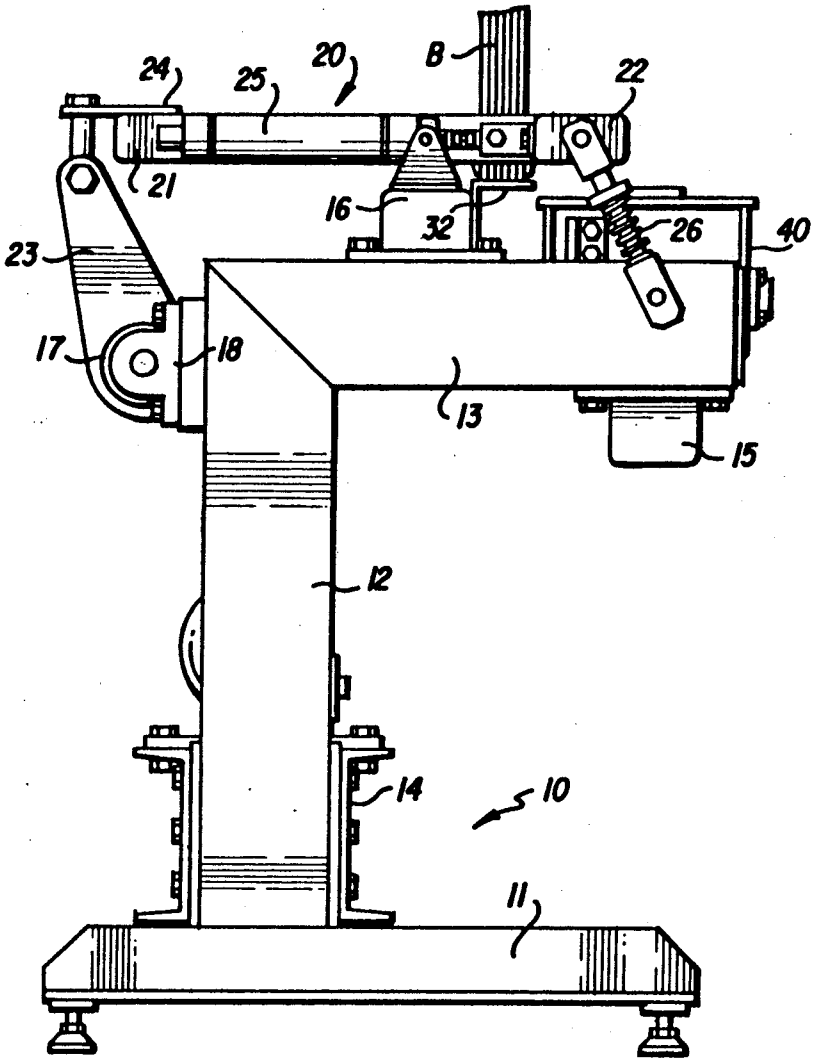
FIG. 3 is a left end elevation of the presently disclosed apparatus.
Figure 12:
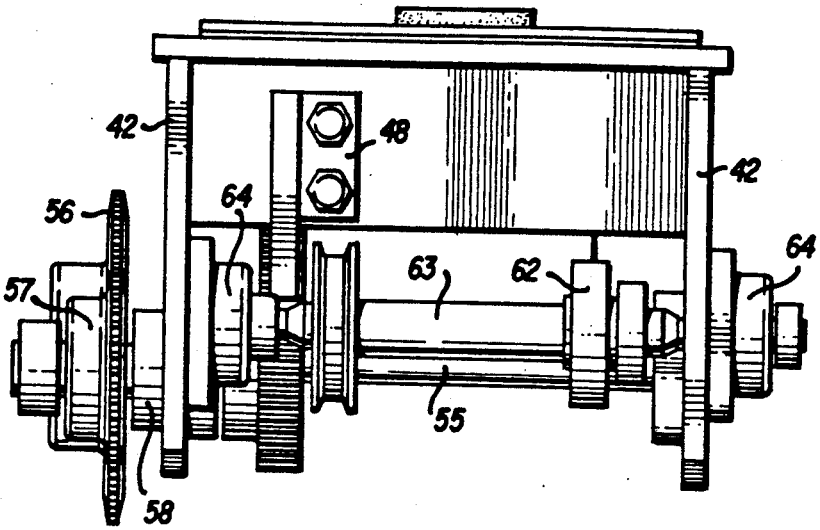
Figure 11:
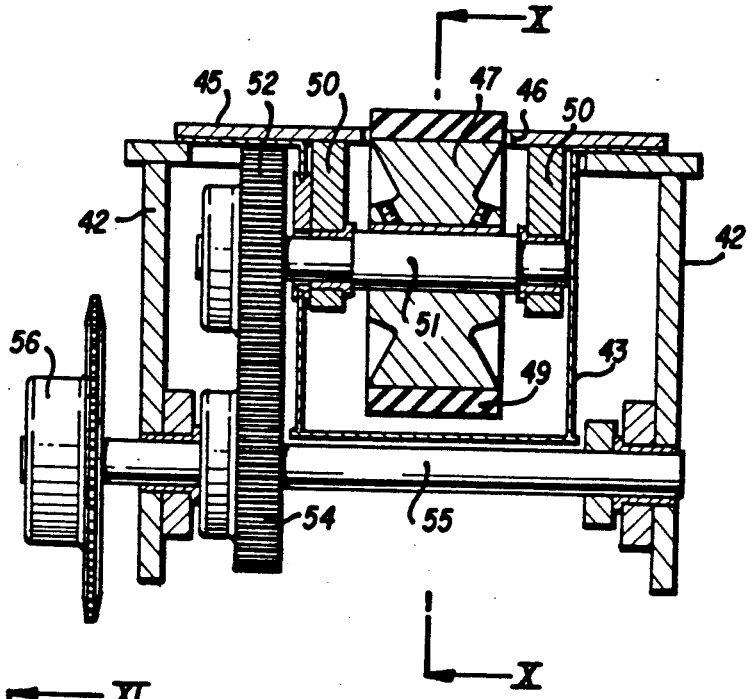
FIG. 11 is a sectional end elevation view of the adhesive application wheel carriage assembly as viewed along cutting plane XI—XI of FIG. 9; and, FIG. 12 is an end elevational view of the adhesive application wheel carriage assembly as viewed along cutting plane XII—XII of FIG. 10.
Figure 9:
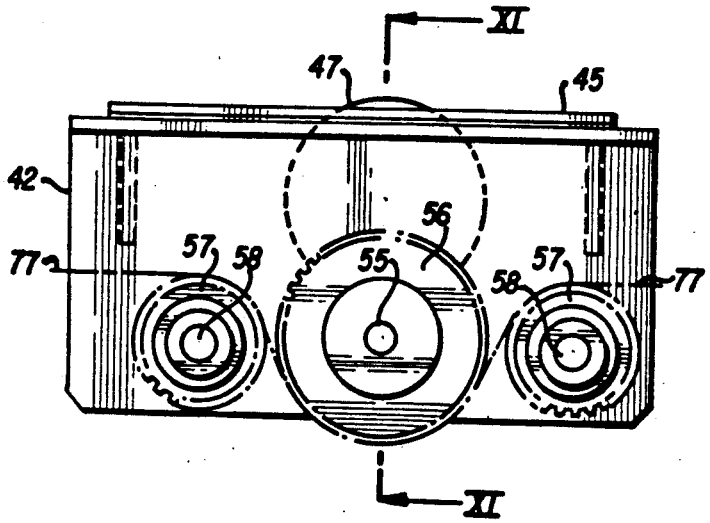
FIG. 9 is a drive side elevational view of the adhesive application wheel carriage assembly.

A plurality of pre-sized veneer drips B are positioned between the jaws 33 with the veneer strip bottom edges flush against the alignment bed 32 surface as shown by FIGS. 3, 4 and 5. In this condition, the jaws 33 are closed by motors 31 against the veneer strip bundle B, and the translation motor 25 is actuated to shift the entire clamp frame assembly 20 forward thereby placing the exposed lower edges of bundle B over the carriage 40 traverse plane as shown by FIG. 6.

Upon manual command, the carriage drive motor 70 is energized in a direction as to rotate the jack shaft drive sprocket 85 and jack shaft 84 in a clockwise direction as viewed from the front elevational perspective of FIG. 1. Such rotary motion of the jack shaft 84 rotates the carriage traverse chain sprocket 75 correspondingly, thereby moving the carriage 40 along tracks 41 from left to right. However, due to the over-running clutch 80, the head sprocket 78, which carries the adhesive wheel drive chain 77, is not rotatively driven, there being relative rotary slipping between the jack shaft 84 and the drive hub of clutch 80. Over-running clutch 81 is oriented on idle shaft 86 to further assure that tail sprocket 79 will not rotate in the clockwise direction thereby holding the adhesive wheel drive chain 77 stationary relative to the static frame 10 and tracks 41.

Since the rotational axle 51 of adhesive wheel drive sprocket 56 is physically secured to the carriage 40 but the teeth of sprocket 56 engage the stationary adhesive drive chain 77, movement of the carriage 40 along tracks 41 necessarily causes rotation of the sprocket 56 and, ultimately, adhesive transfer wheel 47 within the glue pan 43. Sufficient viscous adhesive is held within the glue pan reservoir to immerse a chordal portion of the sheet 47. Surface adhesion coats the rubber tire perimeter 49 of the wheel 47 with the adhesive and doctor blade 60 screeds that layer to a regulated thickness which is pressed against the lower edge of the veneer bundle B.

By means of the pivotal link 26 adjustable length, the exact point of veneer wheel 47 engagement with the bundle B may be precisely graduated. Ideally, the wheel 47 should slightly lift the bundle B against the spring bias as a traverse pass is made.

At the end of the transverse pass, carriage 40 engages the limit switch 82 which disconnects electrical power to the motor 70 and reverses the polarity circuit to the motor in preparation for a return traverse. Manually, the clamp jaws 33 are opened as the bundle B is manually supported. The clamp frame assembly 20 is removed to the starting position whereat the bundle B is again inserted between the open jaws and the opposite edges aligned against bed surface 32.

Simultaneously, power is manually restored to the motor 70 which, due to the polarity reversal of limit switch 82, now drives the carriage to the left. In this carriage 40 return mode, jack shaft 84 and carriage traverse sprocket 75 are rotatively driven counterclockwise as viewed from the front elevational perspective of FIG. 1. In this rotational direction, over-running clutch 80 transfers rotary drive torque to the adhesive wheel drive chain head sprocket 78 and, hence, relative movement of the adhesive wheel drive chain 77. Over-running clutch 81 and tail sprocket 79 accommodate such chain 77 movement by free counterclockwise rotation. Consequently, as the traverse chain 74 tows the carriage 40 from right to left (FIG. 1), adhesive wheel drive chain 77 moves with it. There being no rotative movement between the axle 51 of adhesive wheel drive sprocket 56 and the wheel drive chain 77, no rotation of the drive sprocket 56 about axle 51 occurs. Hence, no rotation of the adhesive transfer wheel 47 occurs. At the end of the return pass, limit switch 83 reverses the motor directional polarity and interrupts the power supply.

When utility for the machine is complete for a period of time, the applicator wheel 47 is lifted from the glue pan 43 and carriage 40 by finger holes 53 in the pedestal mounting cover plate 45. As an independent unit, the applicator wheel may be immersed in cleaning solvent.

Like the applicator wheel assembly, the glue pan 43 is held in operative position only by structural fit and gravity. Consequently the pan may also be lifted from the carriage 40 top opening and cleaned by solvent immersion.

Having fully described our invention, obvious alternatives will occur to those of ordinary skill in the art. As our invention, however,

We claim:

1. Adhesive application apparatus comprising:

track supported carriage means for confining an adhesive reservoir and an adhesive application wheel;

carriage drive means for towing said carriage means along a support track in either of two direction; and, adhesive wheel drive means including a first drive shaft rotatively secured to said carriage means, adhesive wheel drive sprocket means secured to said first drive shaft for rotatively driving said adhesive application wheel by engagement with chain means when said carriage means is towed in a first of said two directions and for restraining said adhesive application wheel from rotation when said carriage means is towed in a second of said two directions.

2. Apparatus as described by claim 1 wherein said adhesive application wheel is secured to a second drive shaft and second gear means, also secured to said second drive shaft for meshing with first gear means, is secured to said first drive shaft to rotate said second drive shaft and said adhesive application wheel.

3. Apparatus as described by claim 2 wherein none of said adhesive application wheel, said second drive shaft nor said second gear means have structural fastener attachment to said carriage means.

4. Apparatus as described by claim 1 wherein said chain is threaded over first and second chain carrier sprocket means at track end points in both of said two directions, said first chain carrier sprocket means being secured to a chain drive shaft and said second chain carrier sprocket means being secured to an idle shaft, both of said chain carrier sprocket means being secured to respective shafts by over-running clutch means whereby rotation of said chain drive shaft in a second rotary direction drives said chain means in said second carriage tow direction and rotation of said chain drive shaft in a first rotary direction restrains said chain means from movement.

5. Apparatus as described by claim 4 wherein said chain means is held stationary relative to said track when said carrier means is towed in said first direction and held stationary relative to said carrier means when said carrier means is towed in said second direction.

6. Apparatus as described by claim 4 wherein said chain drive shaft powers said carriage drive means.

* * * * *